US011814872B2

(12) United States Patent
Lin et al.

(10) Patent No.: US 11,814,872 B2
(45) Date of Patent: Nov. 14, 2023

(54) AUTOMATIC MESSY CODE CHARACTER WHEEL CODED LOCK

(71) Applicant: XIAMEN MAKE SECURITY TECHNOLOGY CO., LTD., Fujian (CN)

(72) Inventors: Shaolian Lin, Xiamen (CN); Guanghui Luan, Xiamen (CN)

( * ) Notice: Subject to any disclaimer, the term of this patent is extended or adjusted under 35 U.S.C. 154(b) by 435 days.

(21) Appl. No.: 17/283,959

(22) PCT Filed: Oct. 11, 2018

(86) PCT No.: PCT/CN2018/109799

§ 371 (c)(1),
(2) Date: Apr. 9, 2021

(87) PCT Pub. No.: WO2020/073269

PCT Pub. Date: Apr. 16, 2020

(65) Prior Publication Data

US 2021/0396042 A1 Dec. 23, 2021

(51) Int. Cl.
*E05B 37/00* (2006.01)
*E05B 37/02* (2006.01)

(52) U.S. Cl.
CPC ..... *E05B 37/0034* (2013.01); *E05B 37/0048* (2013.01); *E05B 37/0079* (2013.01); *E05B 37/0082* (2013.01); *E05B 37/02* (2013.01)

(58) Field of Classification Search
CPC .. E05B 37/00; E05B 37/0031; E05B 37/0034; E05B 37/0048; E05B 37/0075; E05B 37/0079; E05B 37/0082; E05B 37/02; E05B 37/025; E05B 17/145
USPC ..... 70/284
See application file for complete search history.

(56) References Cited

U.S. PATENT DOCUMENTS 8,316,675 B2 * 11/2012 Yang ..... E05B 13/106 70/284
2018/0106072 A1 * 4/2018 Wu ..... E05B 37/0034
2019/0021451 A1 * 1/2019 Huang ..... E05B 35/105

FOREIGN PATENT DOCUMENTS

KR 101900231 B1 * 9/2018
WO WO-2015024202 A1 * 2/2015 ..... E05B 19/0017

* cited by examiner

*Primary Examiner* — Nathan Cumar

(57) ABSTRACT

An automatic messy code character wheel coded lock includes a housing and a lock case capable of rotating with respect to the housing provided on the housing in a penetrating mode. A lock cylinder assembly is provided in one end of the lock case, and a lock piece is connected to the other end of the lock case. A character wheel shaft is provided in the housing. Several bushings are sleeved on the character wheel shaft. Each bushing is sleeved with a character wheel capable of driving the bushing to rotate together or rotate relatively. Several code characters are provided on a side wall of the character wheel. Each character wheel is provided with a pair of character wheel magnets having opposite poles, and the character wheel shaft is provided with one character wheel shaft magnet corresponding to each pair of character wheel magnets.

10 Claims, 5 Drawing Sheets

AUTOMATIC MESSY CODE CHARACTER WHEEL CODED LOCK

BACKGROUND OF THE INVENTION

1. Field of the Invention

The present invention relates to a character wheel coded lock, and more particularly to an automatic messy code character wheel coded lock.

2. Description of the Prior Art

A combination lock has the convenience of an electronic code lock and the stability of a mechanical lock, so it is widely used. A conventional combination lock will display the correct combination code when it is unlocked and locked. The user needs to reset the dials to prevent the correct combination code from leaking out. The operation is relatively inconvenient. The user is likely to leak out the correct combination code because of forgetting to reset the dials. Therefore, there is a need for a combination lock that can automatically reset the dials to an incorrect combination code after being unlocked and locked.

SUMMARY OF THE INVENTION

The primary object of the present invention is to provide an automatic messy code character wheel coded lock, which can automatically reset character wheels after being unlocked and locked.

In order to achieve the above object, the present invention adopts the following technical solutions:

An automatic messy code character wheel coded lock comprises a housing. A lock case that is rotatable relative to the housing is insertedly connected to the housing. A lock cylinder assembly that is rotatable relative to the lock case is provided in one end of the lock case. A lock piece is connected to another end of the lock case. A character wheel shaft is provided in the housing and configured to move left and right along with rotation of the lock case. The character wheel shaft is sleeved with a plurality of bushings that are movable relative to the character wheel shaft. Each bushing is sleeved with a character wheel that can drive the bushing to rotate together or to rotate relative to each other. A side wall of the character wheel is provided with a plurality of code characters. Each character wheel is provided with a pair of character wheel magnets with opposite poles. The character wheel shaft is provided with character wheel shaft magnets each corresponding to each pair of character wheel magnets.

An outer wall of the lock case has a lock groove that is horizontally arranged. A bottom of the lock groove is formed with a through hole. The lock cylinder assembly is provided with a lock tongue that is rotatable along with the lock cylinder assembly. One side of the lock tongue is provided with a tongue portion that is movably inserted in the through hole. One end of the tongue portion forms an acute-angled tip that movably extends out of the lock case from the through hole. The acute-angled tip is driven to be inserted in and retracted out of the through hole by rotation of the lock cylinder assembly. An inner end of the character wheel shaft movably abuts against the bottom of the lock groove. Two sides of the inner end of the character wheel shaft are in movable contact with the acute-angled tip and a side wall of the lock groove, respectively. A character wheel shaft return spring is provided between an outer end of the character wheel shaft and a side wall of the housing.

The lock tongue is formed with a perforation and an engaging block. The lock cylinder assembly includes a rotating shaft that is movably inserted in the perforation and a push block that is in movable contact with the engaging block. The lock tongue is provided with a lock tongue return spring that is located between another side of the lock tongue opposite to the tongue portion and a side wall of the lock case. One side of the tongue portion has a triangular recess. A side wall of the through hole is provided with a triangular protrusion that is movably engaged in the triangular recess.

The side wall of the character wheel is formed with a plurality of limiting recesses that are uniformly arranged along a circumferential direction of the character wheel. The limiting recesses correspond to the code characters of the character wheel, respectively. The housing is provided with a lifting rod that can move up and down as the lock case rotates. The lifting rod is provided with a plurality of character wheel positioning plates corresponding to and cooperating with the respective character wheels. The character wheel positioning plates each have a limiting protrusion that is movably engaged with one of the limiting recesses.

The side wall of the lock case is formed with a U-shaped cam groove. An inner end of one side of the lifting rod is provided with a limiting rod inserted in the U-shaped cam groove. The lifting rod is arranged under the character wheel shaft. A middle portion of the lifting rod is in movable contact with a bottom of the housing. The character wheel positioning plates are arranged between the lifting rod and the character wheel shaft. Two ends of each character wheel positioning plate are defined as a first end and a second end that are tilted upward. The first end of each character wheel positioning plate is provided with the limiting protrusion. A return elastic plate is provided between a bottom of the first end of each character wheel positioning plate and the bottom of the housing. The lifting rod is in movable contact with the second end of each character wheel positioning plate.

The character wheel is provided with a mistake-proofing protrusion. The second end of each character wheel positioning plate is in movable contact with the mistake-proofing protrusion.

The side wall of the lock case is formed with an aperture. The aperture is fitted with a movable rod to move left and right along with rotation of the lock cylinder assembly. An inner end of the movable rod is in contact with the lock cylinder assembly. An outer end of the movable rod is in contact with the inner end of the lifting rod. A lifting rod return spring is provided between an outer end of the lifting rod and a side wall of the housing. The housing is provided with a code search member to move up and down along with the lifting rod that is moved left and right. The code search member is provided with elastic pawls that correspond to the respective bushings and are movably engaged with the respective bushings.

A movable rod spring is provided between the movable rod and the inner end of the lifting rod.

The character wheel shaft is provided with bumps corresponding to the respective bushings. The bumps are arranged in a linear structure parallel to an axial direction of the character wheel shaft. Each bushing has a notch for movably engaging with a corresponding one of the elastic pawls and a through groove which is movably matched with a corresponding one of the bumps. The notch and the through groove of each bushing are arranged in a position where the corresponding bump is aligned with the through groove when the corresponding elastic pawl is engaged with the notch.

Each character wheel has an inner hole provided with internal teeth. An outer wall of each bushing is provided with external teeth to mesh with the internal teeth. A code change button is provided in the housing for controlling the internal teeth of the character wheels to mesh with or not to mesh with the external teeth of the bushings.

After adopting the above solutions, under the magnetic action between the character wheel magnets and the character wheel shaft magnets, the character wheels automatically rotate to reset the character wheels to the incorrect combination code after being unlocked and locked.

DETAILED DESCRIPTION OF THE PREFERRED EMBODIMENTS

Embodiments of the present invention will now be described, by way of example only, with reference to the accompanying drawings.

Figure 1:
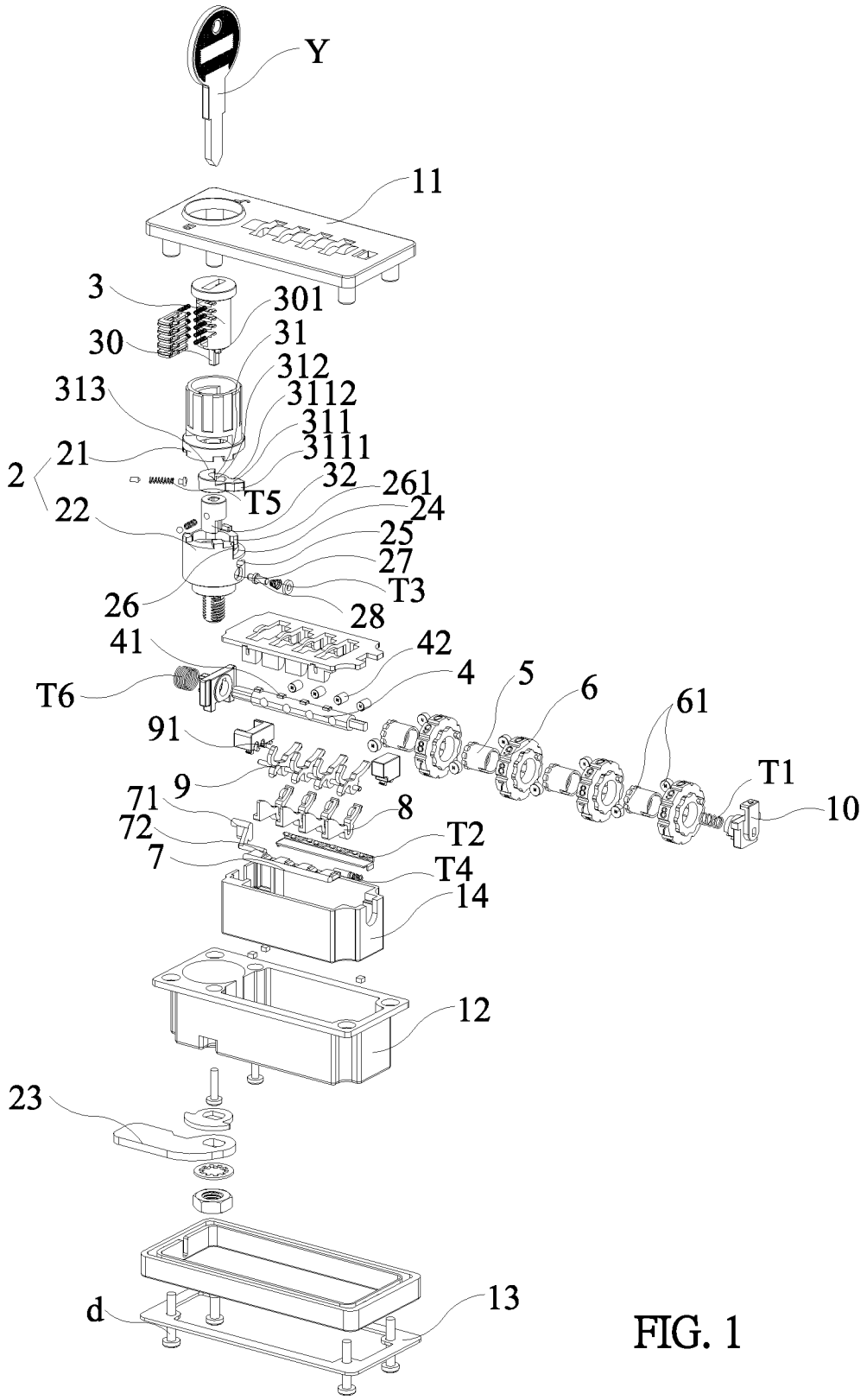
FIG. 1 is an exploded view of the present invention.
Figure 2:
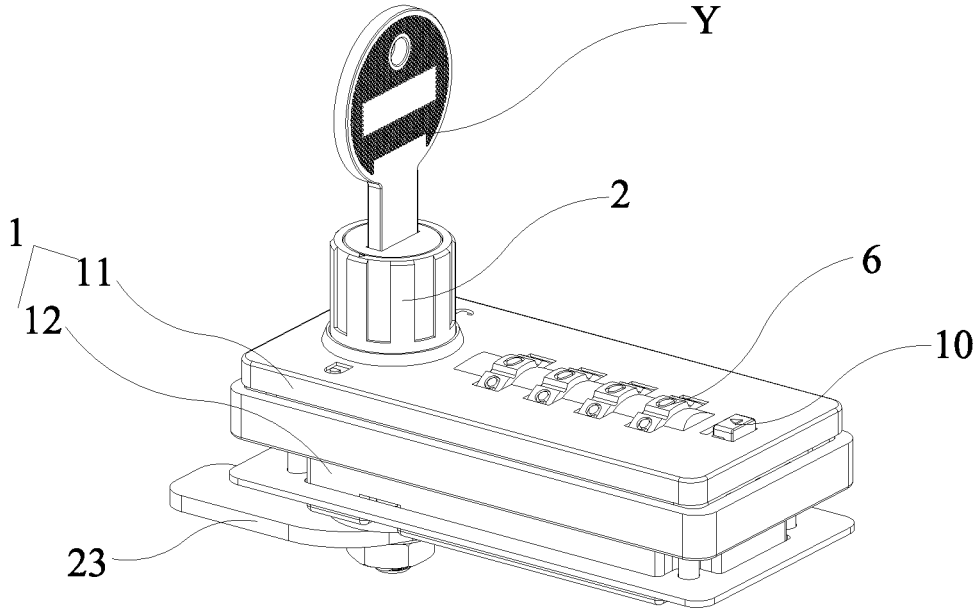
FIG. 2 is a perspective view of the present invention.
Figure 3:
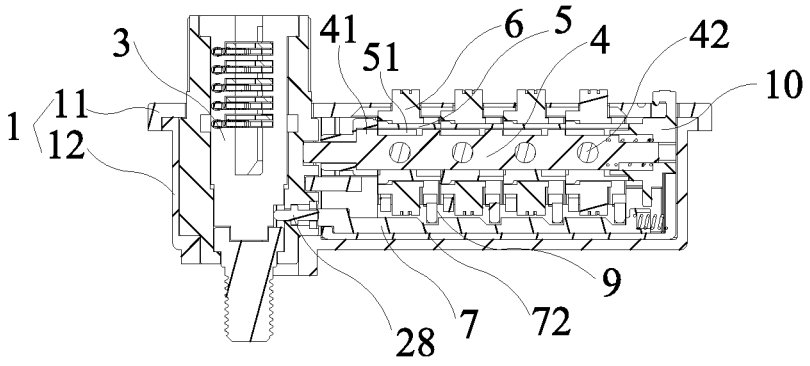
FIG. 3 is a partial cross-sectional view of the present invention.
Figure 4:
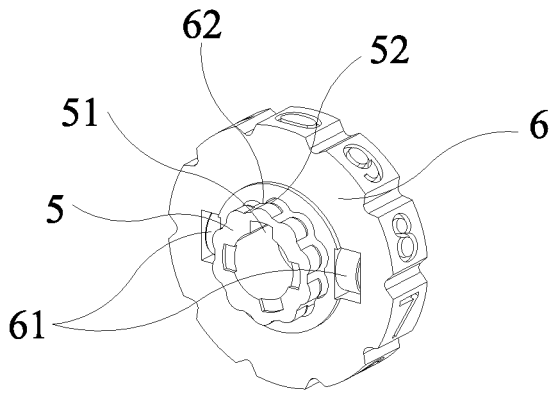
FIG. 4 is a first schematic view showing the cooperation between the character wheel and the bushing of the present invention.
Figure 5:
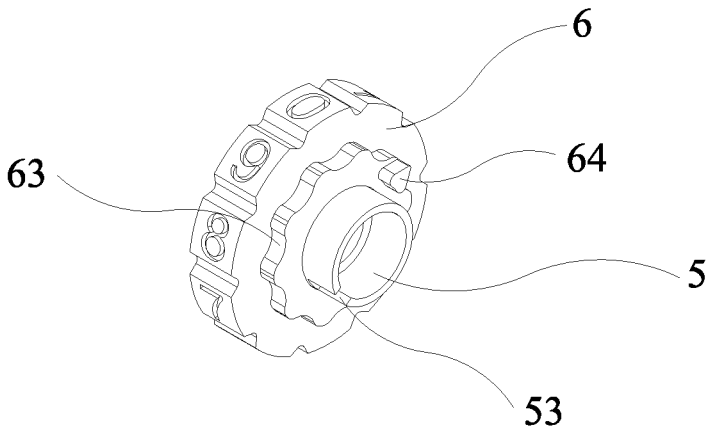
FIG. 5 is a second schematic view showing the cooperation between the character wheel and the bushing of the present invention.
Figure 6:
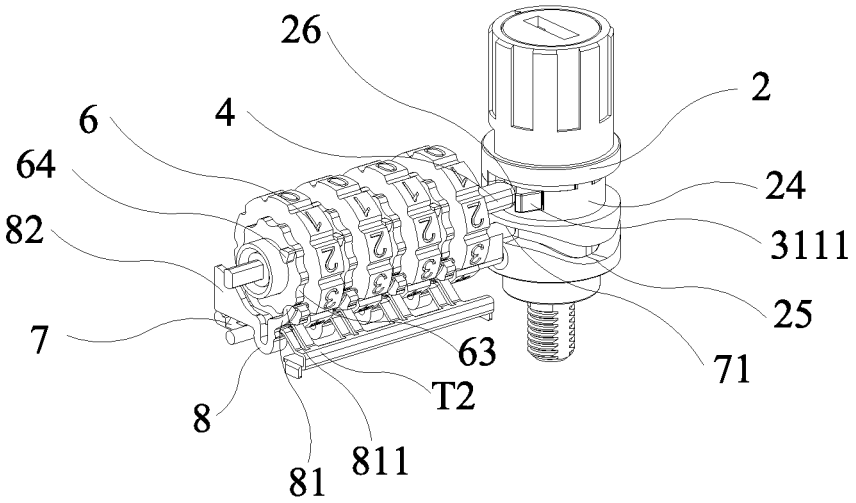
FIG. 6 is a perspective view showing the cooperation between the character wheel positioning plate and the character wheel of the present invention.
Figure 7:
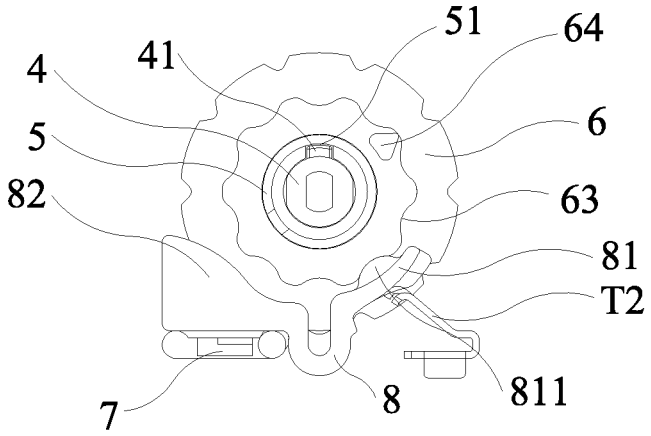
FIG. 7 is a first planar view showing the cooperation between the character wheel positioning plate and the character wheel of the present invention.
Figure 8:
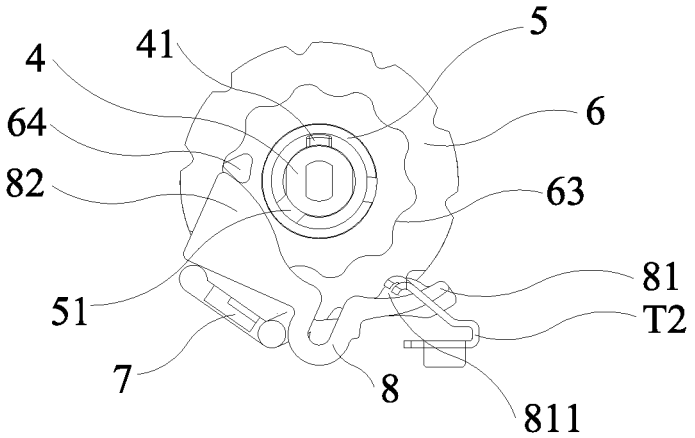
FIG. 8 is a second planar view showing the cooperation between the character wheel positioning plate and the character wheel of the present invention.
Figure 9:
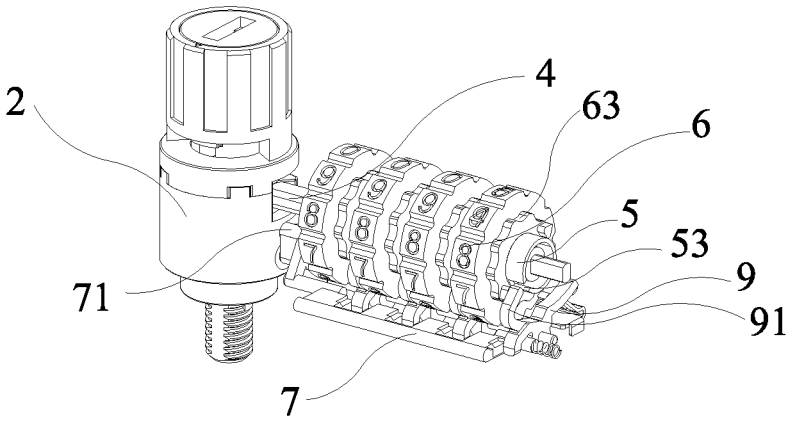
FIG. 9 is a perspective view showing the cooperation between the code search member and the character wheels of the present invention.
Figure 10:
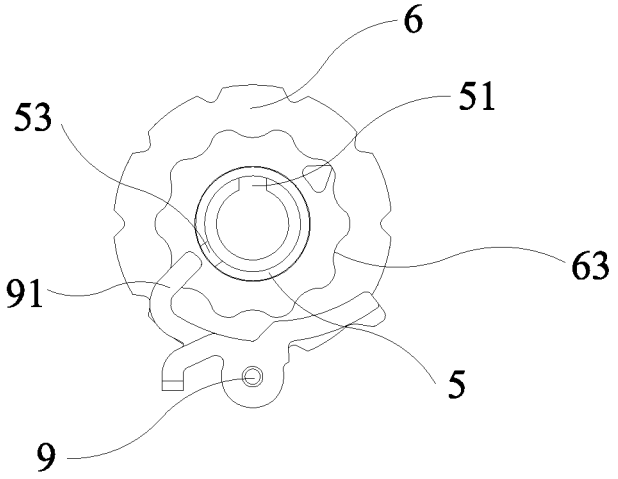
FIG. 10 is a first planar view showing the cooperation between the code search member and the character wheels of the present invention.
Figure 11:
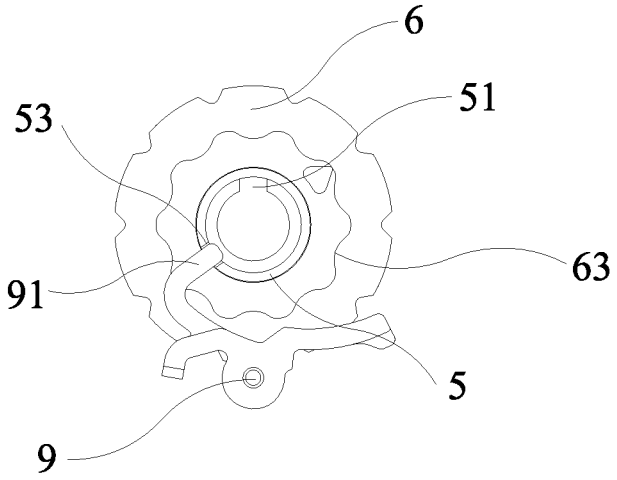
FIG. 11 is a second planar view showing the cooperation between the code search member and the character wheels of the present invention.

As shown in FIGS. 1 to 11, the present invention discloses an automatic messy code character wheel coded lock, comprising a housing 1. The housing 1 is composed of an upper housing 11 and a lower housing 12. Amounting plate 13 is connected to the bottom of the housing 1 by screws d. A lock case 2 that is rotatable relative to the housing 1 is insertedly connected to the housing 1. The lock case 2 is composed of an upper lock case 21 and a lower lock case 22. The upper and lower ends of the lock case 2 extend out of the housing 1, respectively. A lock cylinder assembly 3 that is rotatable relative to the lock case 2 is provided in one end of the lock case 2. A lock piece 23 is connected to the other end of the lock case 2. A code box 14 is provided in the housing 1. A character wheel shaft 4 is provided in the code box 14. The character wheel shaft 4 is configured to move left and right along with rotation of the lock case 2. Specifically, the outer wall of the lock case 2 has a lock groove 24 that is horizontally arranged. The bottom of the lock groove 24 is formed with a through hole 26. The lock cylinder assembly 3 is provided with a lock tongue 31 that is rotatable along with the lock cylinder assembly 3. One side of the lock tongue 31 is provided with a tongue portion 311 that is movably inserted in the through hole 26. One end of the tongue portion 311 forms an acute-angled tip 3111 that movably extends out of the lock case 2 from the through hole 26. The lock tongue 31 is an eccentric structure so that the rotation of the lock cylinder assembly 3 can bring the acute-angled tip 3111 to be inserted in and retracted out of the through hole 26. The inner end of the character wheel shaft 4 movably abuts against the bottom of the lock groove 24. Two sides of the inner end of the character wheel shaft 4 are in movable contact with the acute-angled tip 3111 and the side wall of the lock groove 24. A character wheel shaft return spring T1 is provided between the outer end of the character wheel shaft 4 and the side wall of the housing 1. Through the acute-angled tip 3111 of the lock tongue 31 and the character wheel shaft return spring T1, the character wheel shaft 4 can move left and right along with the rotation of the lock case 2. When the character wheel coded lock of the present invention is locked, the two sides of the inner end of the character wheel shaft 4 are engaged with one side of the acute-angled tip 3111 and a side wall of the lock groove 24, respectively. The lock tongue 31 is formed with a perforation 312 and an engaging block 313. The lock cylinder assembly 3 includes a rotating shaft 30 that is movably inserted in the perforation 312 and a push block 301 that is in movable contact with the engaging block 313. The lock cylinder assembly 3 pushes the lock tongue 31 to rotate through the push block 301 to push the engaging block 313. The lock tongue 31 is provided with a lock tongue return spring T5 that is located between the other side of the lock tongue 31 opposite to the tongue portion 311 and the side wall of the lock case 2. One side of the tongue portion 311 has a triangular recess 3112. The side wall of the through hole 26 is provided with a triangular protrusion 261 that is movably engaged in the triangular recess 3112. The triangular recess 3112 and the triangular protrusion 261 form a stop mechanism. The stop mechanism makes the character wheel shaft 41 unable to move left and right relative to the bushings 5 when the two sides of the inner end of the character wheel shaft 4 are respectively engaged with the side of the acute-angled tip 3111 and the side wall of the lock groove 24. In this way, when the lock case 2 is rotated, the inner end of the character wheel shaft 4 cannot be disengaged from the side of the acute-angled tip 3111 and the side wall of the lock groove 24, thereby ensuring the safety of the lock. For the user to rotate the lock cylinder assembly 3, the lock cylinder assembly 3 has a lock hole. The lock hole is in cooperation with a key Y. When the user forgets the correct combination code, the user can insert the key Y into the lock cylinder assembly 3 and turn the lock cylinder assembly 3, so that the acute-angled tip 3111 of the lock tongue 31 is inserted into the through hole 26 and the inner end of the character wheel shaft 4 is not caught by the acute-angled tip 3111. At this time, the lock case 2 will not be confined by the character wheel shaft 4, and the lock case 2 can be rotated to unlock the character wheel coded lock.

The character wheel shaft 4 is sleeved with a plurality of bushings 5 that are movable relative to the character wheel shaft 4. Specifically, the character wheel shaft 4 is provided with bumps 41 corresponding to the respective bushings 5. The bumps 41 are arranged in a linear structure parallel to the axial direction of the character wheel shaft 4. Each bushing 5 has a through groove 51 which is movably matched with the corresponding bump 41. When the respective bumps 41 of the character wheel shaft 4 are aligned with the through grooves 51 of the respective bushings 5, the bumps 41 of the character wheel shaft 4 can pass through the through grooves 51 of the bushings 5, so that the character wheel shaft 4 can move left and right relative to the bushings 5. When the bumps 41 on the character wheel shaft 4 are not aligned with the through groove 51 of at least one of the bushings 5, the bumps 41 on the character wheel shaft 4 will be caught by the bushings 5, so that the character wheel shaft 4 cannot move relative to the bushings 5.

Each bushing 5 is sleeved with a character wheel 6 that can drive the bushing 5 to rotate together or rotate relative to each other. The side wall of the character wheel 6 is provided with a plurality of code characters. Each character wheel 6 is provided with a pair of character wheel magnets 61 with opposite poles. The character wheel shaft 4 is provided with character wheel shaft magnets 42 each corresponding to each pair of character wheel magnets 61. Specifically, the inner hole of each character wheel 6 is provided with internal teeth 62, and the outer wall of each bushing 5 is provided with external teeth 52 that cooperate with the internal teeth 62. When the external teeth 52 of the bushing 5 are matched with the internal teeth 62 of the character wheel 6, the bushing 5 and the character wheel 6 are engaged with each other so that the character wheel 6 can drive the bushing 5 to rotate together. When the external teeth 52 of the bushing 5 are not meshed with the internal teeth 62 of the character wheel 6, the bushing 5 and the character wheel 6 are not engaged with each other so that the character wheel 6 cannot drive the bushing 5 to rotate. The character wheel shaft magnets 42 can be fitted into the holes of the character wheel shaft 4. The character wheel magnets 61 are fitted into the holes of the character wheel 6.

To facilitate the understanding of the present invention, the following describes the unlocking process and the locking process of the present invention.

When the character wheels 6 of the present invention are not set to the correct combination code, the bumps 41 of the character wheel shaft 4 are not aligned with the through groove 51 of at least one of the bushings 5, so the character wheel shaft 4 cannot move left and right relative to the bushings 5. At this time, the inner end of the character wheel shaft 4 is caught by the side of the acute-angled tip 3111 and the side wall of the lock groove 24. Through the stop mechanism, when the lock case 2 is rotated, the inner end of the character wheel shaft 4 cannot be disengaged from the side of the acute-angled tip 3111 and the side wall of the lock groove 24. In this way, the lock case 2 is caught by the character wheel shaft 4, so the lock case 2 cannot be rotated.

When the character wheel coded lock provided by the present invention is to be unlocked, the character wheels 6 are set to the correct combination code. At this time, the respective bumps 41 on the character wheel shaft 4 are aligned with the through grooves 51 of the respective bushings 5, such that the character wheel shaft 4 can move left and right relative to the bushings 5 and the lock case 2 is not caught by the character wheel shaft 4. At this time, the lock case 2 can be rotated in the forward direction to unlock the character wheel coded lock. When the lock case 2 is rotated in the forward direction, the character wheel shaft 4 is pushed to move through the acute-angled tip 3111 to unlock the character wheel coded lock. Due to the action of the acute-angled tip 3111 of the lock tongue 31, the rotation of the lock case 2 enables the respective bumps 41 of the character wheel shaft 4 to be inserted in the through grooves 51 of the respective bushings 5 and then retracted out of the through grooves 51 of the respective bushings 5. When the bumps 41 of the character wheel shaft 4 are retracted from the through groove 51 of the respective bushings 5, the bushings 5 and the character wheels 6 can be rotated. At this time, under the magnetic action between the character wheel magnets 61 and the character wheel shaft magnets 42, the character wheels 6 automatically rotate to reset the character wheels 6 to an incorrect combination code.

When the character wheel coded lock provided by the present invention is to be locked, the lock case 2 is rotated in the reverse direction. The inner end of the character wheel shaft 4 first presses the acute-angled tip 3111 of the lock tongue 31 so that the acute-angled tip 3111 of the lock tongue 31 enters the through hole 26, and the lock tongue return spring T5 is compressed. The character wheel shaft 4 can pass through the acute-angled tip 3111 of the lock tongue 31. After the character wheel shaft 4 passes through the acute-angled tip 3111 of the lock tongue 31, the lock tongue return spring T5 is returned so that the acute-angled tip 3111 of the lock tongue 31 is retracted out of the through hole 26. The inner end of the character wheel shaft 4 is caught by the side of the acute-angled tip 3111 and the side wall of the lock groove 24 to lock the character wheel coded lock. At this time, the respective bumps 41 of the character wheel shaft 4 are not in the through grooves 51 of the respective bushings 5, so that the bushings 5 and the character wheels 6 can be rotated. At this time, under the magnetic action between the character wheel magnets 61 and the character wheel shaft magnets 42, the character wheels 6 automatically rotate to reset the character wheels 6 to an incorrect combination code.

Furthermore, in order to prevent the situation that when the user performs the unlocking operation, the character wheels 6 automatically rotate under the magnetic action between the character wheel magnets 61 and the character wheel shaft magnets 42. As a result, the user needs to press the character wheels 6 to prevent the character wheels 6 from rotating in order to set the character wheels 6 to the correct combination code. The side wall of the character wheel 6 is formed with a plurality of limiting recesses 63 that are uniformly arranged along the circumferential direction of the character wheel 6. The limiting recesses 63 correspond to the code characters of the character wheel 6, respectively. The housing 1 is provided with a lifting rod 7 that can move up and down as the lock case 2 rotates. The lifting rod 7 is provided with a plurality of character wheel positioning plates 8 corresponding to and cooperating with the respective character wheels 6. The character wheel positioning plates 8 each have a limiting protrusion 811 that is movably engaged with one of the limiting recesses 63. In the present invention, the lifting rod 7 and the character wheel positioning plates 8 on the lifting rod 7 are moved up and down through the rotation of the lock case 2, so as to control whether the limiting protrusion 811 of each character wheel positioning plate 8 is engaged with the corresponding limiting recess 63 or not. When the limiting protrusion 811 is engaged with the corresponding limiting recess 63, the damping of the rotation of the character wheel 6 can be improved, so that the character wheels 6 cannot rotate under the magnetic action between the character wheel magnets 61 and the character wheel shaft magnets 42. At this time, the user can quickly set the character wheels 6 to the correct combination code. When the limiting protrusion 811 is not engaged with the corresponding limiting recess 63, the damping of the rotation of the character wheels 6 is small Under the magnetic action between the character wheel magnets 61 and the character wheel shaft magnets 42, the character wheels 6 automatically rotate to reset the character wheels 6 to an incorrect combination code. Specifically, the side wall of the lock case 2 is formed with a U-shaped cam groove 25. The inner end of one side of the lifting rod 7 is provided with a limiting rod 71 inserted in the U-shaped cam groove 25. The lifting rod 7 is arranged under the character wheel shaft 4. The middle portion of the lifting rod 7 is in movable contact with the bottom of the housing 1 through the code box 14. The character wheel positioning plates 8 are arranged between the lifting rod 7 and the character wheel shaft 4. Two ends of each character wheel positioning plate 8 are defined as a first end 81 and a second end 82 that are tilted upward. The first end 81 of each character wheel positioning plate 8 is provided with the limiting protrusion 811. A return elastic plate T2 is provided between the bottom of the first end 81 of each character wheel positioning plate 8 and the bottom of the housing 1. The other side of the lifting rod 7 is in movable contact with the second end 82 of each character wheel positioning plate 8. When the character wheels 6 of the present invention is in the unlocked state and the locked state, the limiting rod 71 of the lifting rod 7 is located in one of the two top ends of the U-shaped cam groove 25. At this time, the position on one side of the lifting rod 7 is high, and the lifting rod 7 does not lift up the second end 82 of each character wheel positioning plate 8. At this time, the first end 81 of each character wheel positioning plate 8 is lifted upward under the action of the return elastic plate T2, so that the limiting protrusion 811 is engaged with the corresponding limiting recess 63. The damping of the rotation of the character wheels 6 is large. The character wheels 6 cannot rotate under the magnetic action between the character wheel magnets 61 and the character wheel shaft magnets 42. At this time, the user can quickly set the character wheels 6 to the correct combination code. When the user turns the lock case 2 to unlock or lock the character wheel coded lock, the rotation of the lock case 2 enables the limiting rod 71 of the lifting rod 7 to move downward from one top end of the U-shaped cam groove 25 to the bottom end of the U-shaped cam groove 25 and then to move upward to the other top end of the U-shaped cam groove 25. Since the middle portion of the lifting rod 7 is in movable contact with the bottom of the housing 1 through the code box 14, when the limiting rod 71 on one side of the lifting rod 7 moves downward, the other side of the lifting rod 7 will lift up the second end 82 of each character wheel positioning plate 8 and move the first end 81 of each character wheel positioning plate 8 downward. Thus, the limiting protrusion 811 is not engaged with the limiting recess 63, so that the damping of the rotation of the character wheels 6 is small During the downward movement of the limiting rod 71, if the character wheels 6 are set to the correct combination code, under the action of the acute-angled tip 3111 of the lock tongue 31, the rotation of the lock case 2 will enable the bumps 41 of the character wheel shaft 4 to be inserted in the through grooves 51 of the bushings 5 and then retracted out of the through grooves 51 of the bushings 5. After the bumps 41 of the character wheel shaft 4 are retracted out of the through grooves 51 of the bushings 5, the damping of the rotation of the character wheels 6 is small Under the magnetic action between the character wheel magnets 61 and the character wheel shaft magnets 42, the character wheels 6 can rotate to reset the character wheels 6 to the incorrect combination code.

Further, when the combination code is set, it is required to avoid the situation that the position of the character wheel 6 is set to a position where the character wheel shaft magnet 42 and the character wheel magnet 61 have the same poles and are directly opposite to each other. This position is a mistake position. In the mistake position, the character wheels 6 cannot rotate to reset the character wheels 6 to an incorrect combination code. The character wheel 6 is provided with a mistake-proofing protrusion 64. The second end 82 of each character wheel positioning plate 8 is in movable contact with the mistake-proofing protrusion 64. In this way, If the character wheel 6 is set to the mistake position, when the limiting rod 71 on one side of the lifting rod 7 moves downward, the other side of the lifting rod 7 will lift up the second side of the character wheel positioning plate 8 upward and the first end 81 of the character wheel positioning plate 8 will move downward, so that the limiting protrusion 811 is not engaged with the limiting recess 63. After that, the second end 82 of the character wheel positioning plate 8 continues to be lifted so that the second end 82 of the character wheel positioning plate 8 pushes the mistake-proofing protrusion 64 to rotate a certain angle. As a result, the character wheel 6 continues to rotate, so that the character wheel 6 is free from the mistake position, so as to reset the character wheels 6 to the incorrect combination code.

Furthermore, in order to facilitate the user to retrieve the correct combination code, the side wall of the lock case 2 is formed with an aperture 27. The aperture 27 is fitted with a movable rod 28 to move left and right along with rotation of the lock cylinder assembly 3. An eccentric cam 32 is connected to the lower end of the lock cylinder assembly 3. The eccentric cam 32 is connected to the rotating shaft 30. The inner end of the movable rod 28 abuts against the eccentric cam 32 so that the movable rod 28 can be driven to move left and right by the rotation of the lock cylinder assembly 3. The outer end of the movable rod 28 is in contact with the inner end of the lifting rod 7. A movable rod spring T3 is provided between the movable rod 28 and the inner end of the lifting rod 7. A lifting rod return spring T4 is provided between the outer end of the lifting rod 7 and the side wall of the housing 1. The housing 1 is provided with a code search member 9 that can move up and down along with the left and right movement of the lifting rod 7. The lifting rod 7 has a slope 72. The code search member 9 leans against the slope 72. In this way, when the lifting rod 7 moves left and right, the code search member 9 can be pushed up and down through the slope 72. The code search member 9 is provided with elastic pawls 91 that correspond to the respective bushings 5 and are movably engaged with the respective bushings 5. Each bushing 5 has a notch 53 for movably engaging with the corresponding elastic pawl 91. The notch 53 and the through groove 51 of each bushing 5 are arranged in a position where the corresponding bump 41 is aligned with the through groove 51 when the corresponding elastic pawl 91 is engaged with the notch 53.

When the key Y is inserted into the lock cylinder assembly 3, the lock cylinder assembly 3 is rotated so that the movable rod 28 moves to push the lifting rod 7 to move. The lifting rod 7 moves to push the code search member 9 up. At this time, the character wheels 6 are rotated. When the character wheels 6 are rotated to the correct combination code, the elastic pawls 91 of the code search member 9 are engaged with the notches 53 of the bushings 5 to restrict the rotation of the bushings 5 and the character wheels 6, thereby retrieving the combination code.

Furthermore, in order to facilitate the user to change the combination code, a code change button 10 is provided in the housing 1 for controlling the internal teeth 62 of the character wheels 6 to mesh with or not to mesh with the external teeth 52 of the bushings 5. In this way, when the character wheels 6 are set to the correct the combination code, the user can push the code change button 10 for the internal teeth 62 of the character wheels 6 not to be meshed with the external teeth 52 of the bushings 5. At this time, the user can rotate the character wheels 6 to change the combination code. After the combination code is changed, the user can push the code change button 10 for the internal teeth 62 of the character wheels 6 to be meshed with the external teeth 52 of the bushings 5, so that the character wheels 6 can drive the bushings 5 to rotate. Specifically, the bushings 5 abut against one another. A code change spring T6 is provided between one of the two outmost bushings 5 of the bushings 5 and the housing 1. The other of the two outmost bushings 5 of the bushings 5 is movable against the change code button 10. In this way, when the character wheels 6 are set to the correct combination code, the user can push the code change button 10 to push the bushings 5 to compress the code change spring T6. At this time, the internal teeth 62 of the character wheels 6 are not meshed with the external teeth 52 of the bushings 5, so that the character wheels 6 can be rotated for changing the combination code. After changing the combination code, the user releases the code change button 10. The code change spring T6 is returned to return the bushings 5 so that the internal teeth 62 of the character wheels 6 are meshed with the external teeth 52 of the bushings 5.

Furthermore, in order to distinguish the unlocked state from the locked state of the present invention, a switch mark may be provided on the housing 1.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An automatic messy code character wheel coded lock, comprising: a housing; a lock case that is rotatable relative to the housing being insertedly connected to the housing, a lock cylinder assembly that is rotatable relative to the lock case being provided in one end of the lock case, a lock piece being connected to another end of the lock case; a character wheel shaft being provided in the housing and configured to move left and right along with rotation of the lock case, the character wheel shaft being sleeved with a plurality of bushings that are movable relative to the character wheel shaft, each bushing being sleeved with a character wheel that can drive the bushing to rotate together or to rotate relative to each other, a side wall of the character wheel being provided with a plurality of code characters;

each character wheel being provided with a pair of character wheel magnets with opposite poles, the character wheel shaft being provided with character wheel shaft magnets each corresponding to each pair of character wheel magnets.

2. The automatic messy code character wheel coded lock as claimed in claim 1, wherein an outer wall of the lock case has a lock groove that is horizontally arranged, a bottom of the lock groove is formed with a through hole, the lock cylinder assembly is provided with a lock tongue that is rotatable along with the lock cylinder assembly, one side of the lock tongue is provided with a tongue portion that is movably inserted in the through hole, one end of the tongue portion forms an acute-angled tip that movably extends out of the lock case from the through hole, the acute-angled tip is driven to be inserted in and retracted out of the through hole by rotation of the lock cylinder assembly, an inner end of the character wheel shaft movably abuts against the bottom of the lock groove, two sides of the inner end of the character wheel shaft are in movable contact with the acute-angled tip and a side wall of the lock groove, respectively; and a character wheel shaft return spring is provided between an outer end of the character wheel shaft and a side wall of the housing.

3. The automatic messy code character wheel coded lock as claimed in claim 2, wherein the lock tongue is formed with a perforation and an engaging block, the lock cylinder assembly includes a rotating shaft that is movably inserted in the perforation and a push block that is in movable contact with the engaging block; the lock tongue is provided with a lock tongue return spring that is located between another side of the lock tongue opposite to the tongue portion and a side wall of the lock case, one side of the tongue portion has a triangular recess, and a side wall of the through hole is provided with a triangular protrusion that is movably engaged in the triangular recess.

4. The automatic messy code character wheel coded lock as claimed in claim 1, wherein the side wall of the character wheel is formed with a plurality of limiting recesses that are uniformly arranged along a circumferential direction of the character wheel, and the limiting recesses correspond to the code characters of the character wheel, respectively;

the housing is provided with a lifting rod that can move up and down as the lock case rotates, the lifting rod is provided with a plurality of character wheel positioning plates corresponding to and cooperating with the respective character wheels, and the character wheel positioning plates each have a limiting protrusion that is movably engaged with one of the limiting recesses.

5. The automatic messy code character wheel coded lock as claimed in claim 4, wherein a side wall of the lock case is formed with a U-shaped cam groove, an inner end of one side of the lifting rod is provided with a limiting rod inserted in the U-shaped cam groove, the lifting rod is arranged under the character wheel shaft, a middle portion of the lifting rod is in movable contact with a bottom of the housing, the character wheel positioning plates are arranged between the lifting rod and the character wheel shaft, two ends of each character wheel positioning plate are defined as a first end and a second end that are tilted upward, the first end of each character wheel positioning plate is provided with the limiting protrusion, a return elastic plate is provided between a bottom of the first end of each character wheel positioning plate and the bottom of the housing, and the lifting rod is in movable contact with the second end of each character wheel positioning plate.

6. The automatic messy code character wheel coded lock as claimed in claim 5, wherein the character wheel is provided with a mistake-proofing protrusion, and the second end of each character wheel positioning plate is in movable contact with the mistake-proofing protrusion.

7. The automatic messy code character wheel coded lock as claimed in claim 5, wherein the side wall of the lock case is formed with an aperture, the aperture is fitted with a movable rod to move left and right along with rotation of the lock cylinder assembly, an inner end of the movable rod is in contact with the lock cylinder assembly, an outer end of the movable rod is in contact with the inner end of the lifting rod, a lifting rod return spring is provided between an outer end of the lifting rod and a side wall of the housing; the housing is provided with a code search member to move up and down along with the lifting rod that is moved left and right, and the code search member is provided with elastic pawls that correspond to the respective bushings and are movably engaged with the respective bushings.

8. The automatic messy code character wheel coded lock as claimed in claim 7, wherein a movable rod spring is provided between the movable rod and the inner end of the lifting rod.

9. The automatic messy code character wheel coded lock as claimed in claim 7, wherein the character wheel shaft is provided with bumps corresponding to the respective bushings, the bumps are arranged in a linear structure parallel to an axial direction of the character wheel shaft; each bushing has a notch for movably engaging with a corresponding one of the elastic pawl and a through groove which is movably matched with a corresponding of the bumps; the notch and the through groove of each bushing are arranged in a position where the corresponding bump is aligned with the through groove when the corresponding elastic pawl is engaged with the notch.

10. The automatic messy code character wheel coded lock as claimed in claim 1, wherein each character wheel has an inner hole provided with internal teeth, an outer wall of each bushing is provided with external teeth to mesh with the internal teeth, and a code change button is provided in the housing for controlling the internal teeth of the character wheels to mesh with or not to mesh with the external teeth of the bushings.

* * * * *